US007186333B2

(12) United States Patent
Kluge

(10) Patent No.: US 7,186,333 B2
(45) Date of Patent: Mar. 6, 2007

(54) STORM DRAIN FILTRATION SYSTEM

(75) Inventor: Robert Kluge, El Cajon, CA (US)

(73) Assignee: Greg B. Kent, Oceanside, CA (US)

( * ) Notice: Subject to any disclaimer, the term of this patent is extended or adjusted under 35 U.S.C. 154(b) by 146 days.

(21) Appl. No.: 11/076,543

(22) Filed: Mar. 9, 2005

(65) Prior Publication Data

US 2005/0199537 A1 Sep. 15, 2005

Related U.S. Application Data

(60) Provisional application No. 60/551,955, filed on Mar. 10, 2004.

(51) Int. Cl.
*E03F 5/06* (2006.01)

(52) U.S. Cl. ..... 210/164; 210/502.1; 210/691

(58) Field of Classification Search ..... 210/163, 210/164

See application file for complete search history.

(56) References Cited

U.S. PATENT DOCUMENTS

| | | | | | |
|---|---|---|---|---|---|
| 1,471,819 | A * | 10/1923 | Bauschard | 210/247 |
| 2,182,795 | A * | 12/1939 | Day | 210/164 |
| 5,037,541 | A * | 8/1991 | Ruey-Jang et al. | 210/141 |
| 5,397,464 | A * | 3/1995 | Hannon | 210/163 |
| 5,958,226 | A * | 9/1999 | Fleischmann | 210/165 |
| 6,200,484 | B1 * | 3/2001 | McInnis | 210/693 |
| 6,214,216 | B1 * | 4/2001 | Isaacson | 210/162 |
| 6,254,770 | B1 * | 7/2001 | Remon | 210/163 |
| 6,521,122 | B1 * | 2/2003 | Elliot et al. | 210/163 |
| 6,602,408 | B1 * | 8/2003 | Berkey | 210/170 |
| 6,609,852 | B2 * | 8/2003 | Wimberger | 405/40 |
| 6,743,354 | B1 * | 6/2004 | Evans et al. | 210/164 |
| 6,793,811 | B1 * | 9/2004 | Fleischmann | 210/163 |
| 6,976,808 | B2 * | 12/2005 | Allard | 405/36 |
| 6,986,621 | B2 * | 1/2006 | Allard | 405/36 |
| 6,997,636 | B2 * | 2/2006 | Tremouilhac | 404/5 |
| 2001/0030150 | A1 * | 10/2001 | Remon | 210/163 |
| 2002/0020658 | A1 * | 2/2002 | Isaacson | 210/162 |
| 2003/0132150 | A1 * | 7/2003 | Happel | 210/163 |
| 2005/0183997 | A1 * | 8/2005 | Happel et al. | 210/163 |
| 2005/0199537 | A1 * | 9/2005 | Kluge | 210/164 |
| 2005/0230317 | A1 * | 10/2005 | Belasco et al. | 210/691 |
| 2005/0247612 | A1 * | 11/2005 | Glassheim | 210/163 |
| 2006/0011527 | A1 * | 1/2006 | McDermott et al. | 210/163 |
| 2006/0049085 | A1 * | 3/2006 | Parker | 210/163 |

* cited by examiner

*Primary Examiner*—Robert James Popovics
*Assistant Examiner*—T. Woodruff
(74) *Attorney, Agent, or Firm*—Lisel M. Ferguson

(57) ABSTRACT

A filter system for insertion into a storm drain pipe for filtering liquid runoff. Storm weather or other runoff will filter through this filter system prior to this runoff passing through to the outfall and into oceans, lakes, streams, ponds or other retention areas. The filtration system fits within the storm drain underneath the manhole and will capture all the runoff. The filtration device contains a stainless steel flange which hinges into the storm drain and a main chamber which extends down into the storm drain containing a series of filter chambers. The first level of filtration the hydrocarbon media can be easily replaced once saturated. An overflow opening is located at the upper portion of the liquid capturing chamber which prevents backflow with excessive runoff.

15 Claims, 3 Drawing Sheets

STORM DRAIN FILTRATION SYSTEM

CROSS-REFERENCE TO RELATED APPLICATIONS

This application claims benefit of Ser. No. 60/551,955, filed Mar. 10, 2004, under 35 U.S.C. § 119(e).

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

Not Applicable

BACKGROUND OF THE INVENTION

1. Field of the Invention

This invention pertains generally to a storm drain filtration system, to direct storm water runoff through the filter prior to entry into the natural watershed system.

2. Description of Related Art

The detrimental effects of storm water runoff are vast and well known and have led to the creation of the Clean Water Act by the Federal Government and enforced by Environmental Protection Agency (EPA). Over the years, private companies have developed several filtration systems to be installed in storm drains. However, one significant problem that has consistently plagued these systems is the inability to filter high water flow in times of excessive rain, and simultaneously maintain a high degree of filtration. Also previous filters need to be custom made to a particular storm drain and are not adjustable to fit in a variety of drains causing the product to be much more expensive than the system set forth herein. Lastly, even in times of high water flow this system prevents resuspension of large debris and captures it in the filter. Unlike other systems this filter can be easily removed from the drain to be cleaned out.

All of these problems have been critical barriers in the filtration of storm water. For example, many of the presently available filtration systems are very inefficient because they only have one level of filtration, have a low hydraulic capacity, and cannot be easily emptied and replaced.

The present invention recognizes the present drawbacks and provides a solution to one or more of the problems associated therewith.

BRIEF SUMMARY OF THE INVENTION

A storm drain filtration system is placed directly into a storm drain and sits on a z channel. The top plate of the unit is cut to fit the vault opening, various size circular or oval hydrocarbon rings are attached to the top plate. The filter system is made of rust resistant metal, durable plastic or fiberglass. The size of the capturing chamber to be attached to the top plate and hydrocarbon ring is based upon the width and depth of the concrete or metal vault. This system comes in multiple different sizes which allows a larger storm drain to house a larger system and increase its hydraulic capacity. This system includes a circular or oval capturing chamber utilizing two or more level of filtration depending on the capacity of the system. The storm water is directed to initially flow into a ring of hydrocarbon medium located at the top hydrocarbon ring of the system. The ring is adjustable up or down to provide the best possible flow through the hydrocarbon medium. A high flow bypass opening is located below the hydrocarbon ring preventing backflow when the flow rate exceeds the filter capacity. A metal, plastic or fiberglass splash shield which extends and inch into the chamber for the full circumference, further prevents resuspension of larger materials which have been captured by the system.

The system uses a perforated metal or wire mesh which is comprised of only non-ferrous materials and is more durable and rust resistant then the wire mesh used by prior art. Just below the bypass the system comprises three or more levels of filtration. The levels comprise a graduated filtration of the water by particle size. The fist top level filtering out the largest particles and the third lowest level filtering out the smallest particles. Unlike previous art the instant system requires no assembly inside the collection box.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus generally shown in FIG. 1 through FIG. 5. It will be appreciated that the apparatus may vary as to configuration and as to details of the parts

DESCRIPTION OF A PREFERRED EMBODIMENT OF THE PRESENT INVENTION

Figure 1:
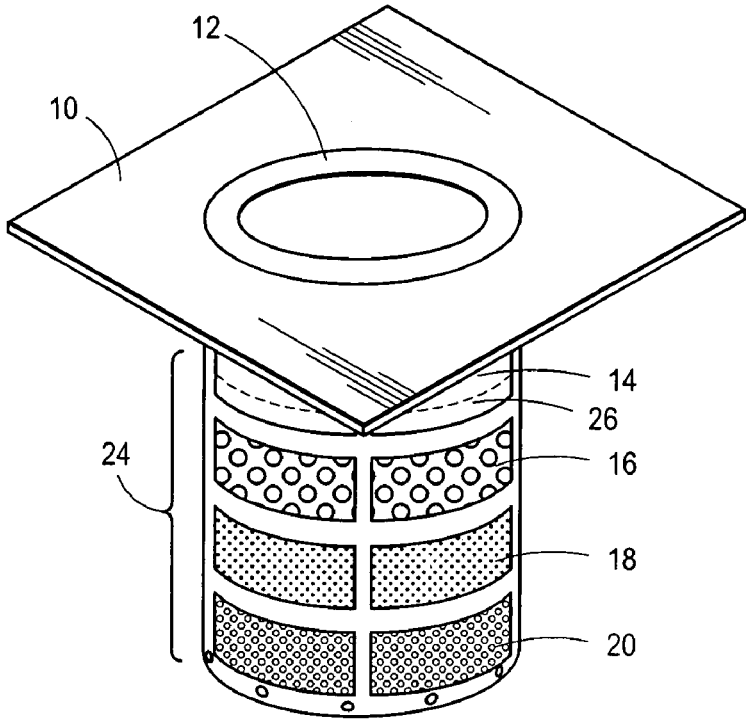
FIG. 1 is a perspective view of a storm drain filter system according to the present invention.
Figure 2:
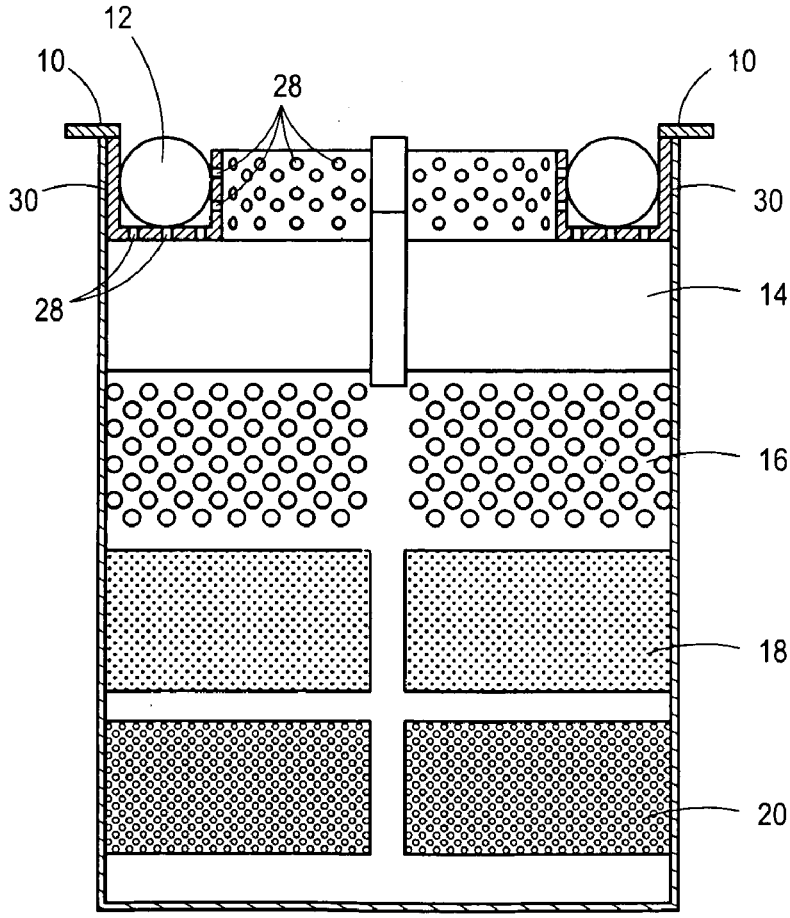
FIG. 2 is a side plan view of a storm drain filter according to the present invention.
Figure 3:
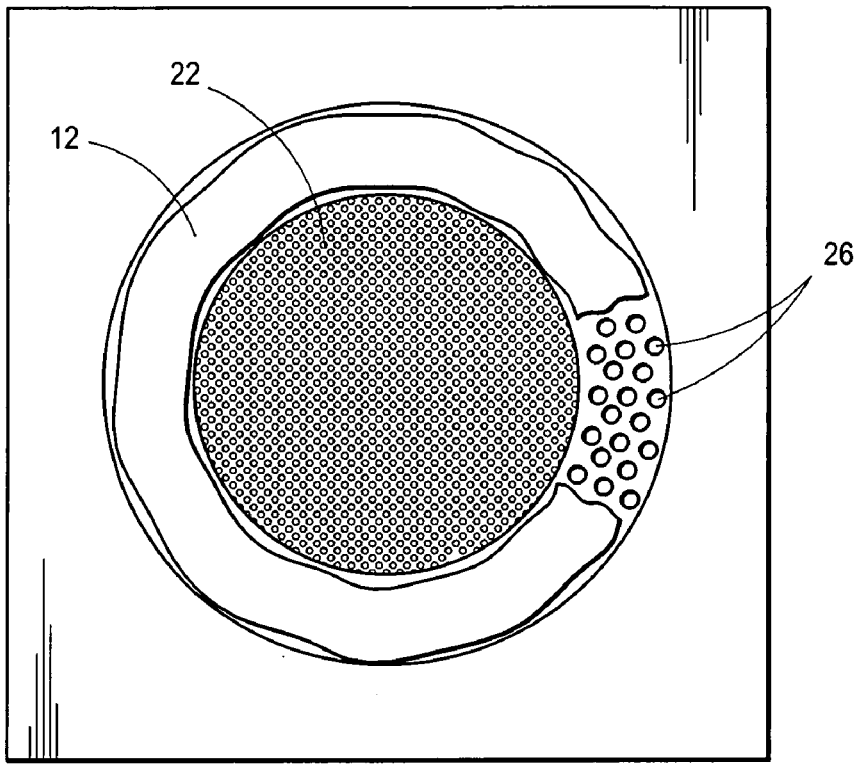
FIG. 3 is a top plan view of storm drain filter system according to the present invention.
Figure 4:
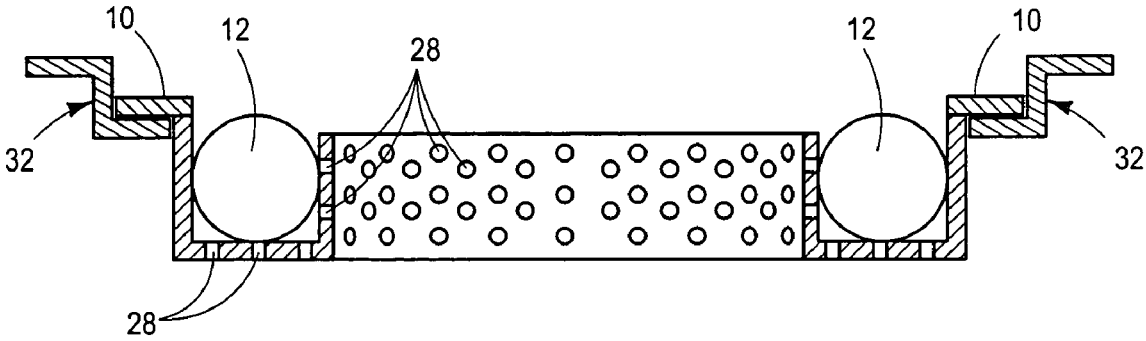
FIG. 4 is a side plan view of the upper portion of the storm drain filtration system showing the hydrocarbon ring.

Referring initially to FIG. 1 and FIG. 2, a storm drain system is shown and is generally designated. This system may be constructed from metal, fiberglass, plastic or similar material. A removable top plate FIG. 1 (10) with attached hydrocarbon ring FIG. 1 (12) is attached to the main chamber FIG. 1 (24) of the drain system. This top plate sits on a metal or plastic Z channel FIG. 4 (32) which rests on the concrete or metal lip that is part of the existing or new concrete vault and allows the main chamber FIG. 1 (24) of the drain system to hang below the top grate and hang into the open space of the storm drain vault. The top plate FIG. 1 (10) can be detached from the main chamber FIG. 1 (24). The top plate FIG. 1 (10) is manufactured oversized and can be easily cut down to fit various concrete vaults. Once the top plate FIG. 1 (10) with the attached hydrocarbon ring FIG. 1 (12) is cut to the correct size the main chamber FIG. 1 (24) is attached to the top plate and is ready for installation into the vault. Water which flows into the storm drain is directed to the hydrocarbon medium FIGS. 1, 2 and 4 (12). The water flows through this hydrocarbon medium allowing for filtration of hydrocarbons, oils and other substances.

As shown, the storm drain system includes a main chamber FIG. 1 (24) which is generally round or oval. This main chamber is split into various levels of filtration. The chamber shown has three levels of filtration FIGS. 1 and 2 (16, 18, 20). Water flows through the hydrocarbon medium FIGS. 1 and 2 (12) and then through the three levels of filtration. During times of excessive runoff this system is equipped with a high flow bypass FIGS. 1 and 2 (14). This bypass allows water and large particles of debris to escape so that the filter system does not become backed up. The system also contains a splash shield FIG. 1 (26) which extends the diameter of the chamber approximately 1 to 3 inches into the chamber. This splash shield prevents trash from re-suspending and escaping out of the filter. In normal flow conditions water flows through the hydrocarbon medium (12) and drops to the bottom of the basket highest level of filtration, FIGS. 1 and 2 (20) and FIG. 3 (22), which is the first level of perforated metal. As the unit fills up to the second level of filtration (18) larger particles of sediments and debris are captured until the water level reaches least level of filtration (16) which contains half inch (½") perforated holes. Once this level is impacted and can no longer allow water to flow out of the filtration levels of the unit, the water passes through the high flow bypass FIG. 1 and FIG. 2 (14).

Figure 5:
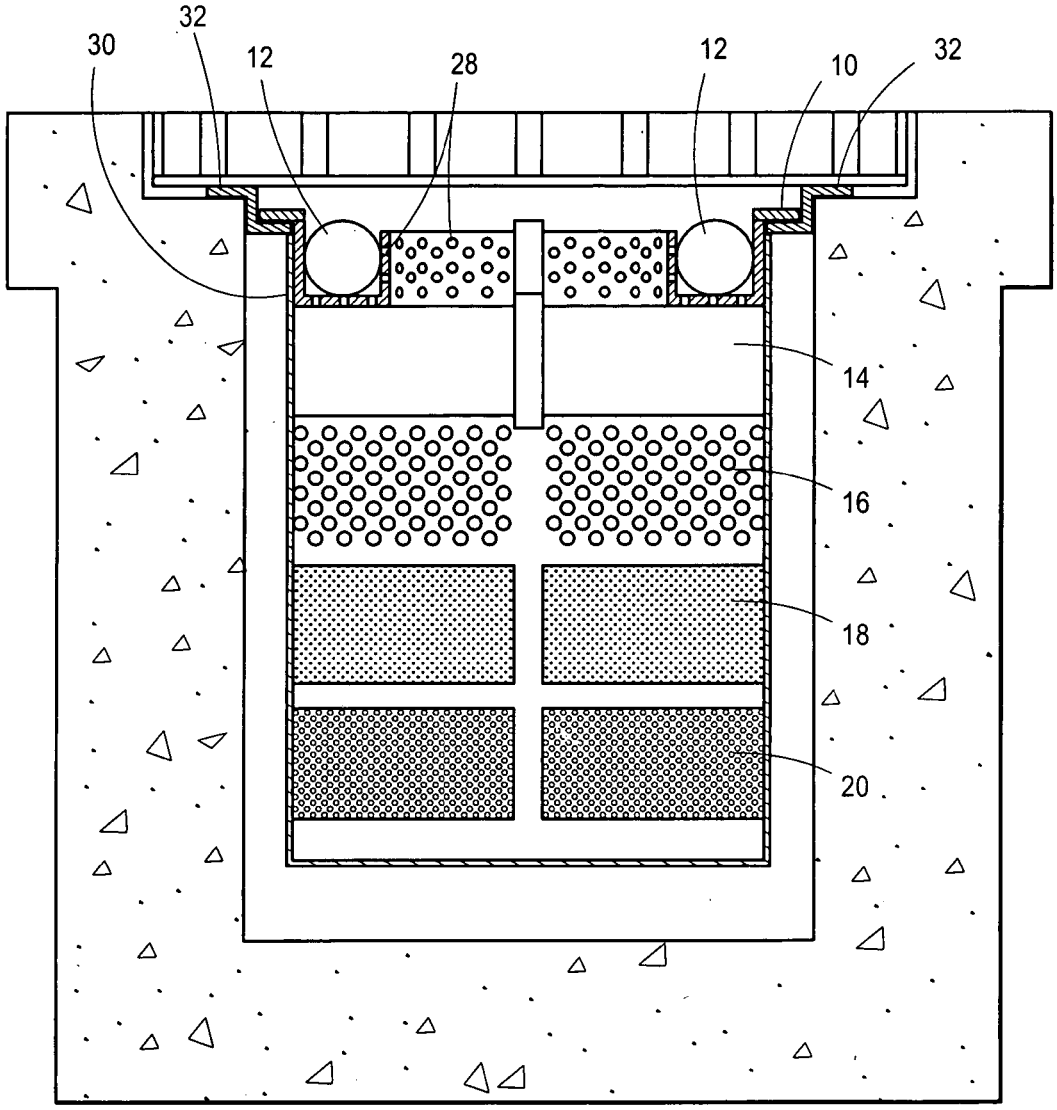
FIG. 5 is a side plan view of a storm drain filter which is installed in a storm drain.

This system can be cleaned without removal of the unit from the storm drain. FIG. 5 shows the system when installed in the storm drain.

I claim:

1. A storm drain filter system to capture liquid runoff comprising:

a liquid capturing chamber shaped to hang into multiple sizes of storm drains, secured by a top plate overlapping the circumference of the storm water hole, the chamber having an inlet, an overflow outlet and multiple levels of outflow filtration therein below said inlet, the top plate of the chamber having a circular or oval ring compartment having an interior, exterior and a half bottom wall with holes in the interior and bottom wall, and forming a periphery on the outside of the chamber inlet, the overflow outlet just below the ring compartment with a back flow shield extending into the chamber;

a ring of hydrocarbon filtration material located in the ring compartment for removing hydrocarbons, oils and other small particles;

said capturing chamber having multiple levels of perforated metal filtering plates containing holes or wire mesh screen below the overflow outlet, whereby the water passes through the plate or screen and into the drain, the plate or screen at the bottom of the chamber having the smallest diameter filtering holes, the plate or screens above the lower plate or screen being of successively larger diameter holes, runoff entering said storm drain is filtered through the hydrocarbon and screens and the particles, debris and solids are captured in said chamber.

2. A storm drain filter system in accordance with claim 1 in which the top plate with attached ring compartment are one unit and can be adjusted up or down on the capturing chamber to increase or decrease the size of the overflow outlet.

3. A storm drain top plate with attached ring compartment in accordance with claim 2 in which this unit is detachable from the capturing chamber.

4. A storm drain top plate with attached ring compartment in accordance with claim 2 which rests on a z channel allowing it to freely hang in a storm drain vault.

5. A storm drain filter system in accordance with claim 1 in which the top plate can be cut down to fit various sized storm drain vaults.

6. A storm drain filter system in accordance with claim 1 in which overflow outlet will allow water to bypass the system during excessive runoff to avoid restriction of flow through the filter and overflow or back fill in the street.

7. A storm drain filter system in accordance with claim 1 in which the hydrocarbon filtration material in the ring compartment can be easily removed and replaced with new hydrocarbon filtration material.

8. A storm drain filter system in accordance which claim 1 including a backflow shield, which runs the circumference of the chamber just below the overflow outlet and extends one to five inches into the chamber, which will inhibit resuspension of solid materials but not limit the volume of the flow through the filter.

9. A backflow shied in accordance with claim 8 which is located below the overflow outlet and above the first level of perforated metal filter plates.

10. A storm drain filter system in accordance with claim 1 which can be easily removed by for cleaning out debris which has been captured from the liquid runoff.

11. A storm drain filter system in accordance with claim 1 wherein the liquid capturing chamber comes in various sizes which each have various flow rate capacities.

12. A storm drain filter system in accordance with claim 1 wherein the liquid capturing chamber is comprised of a non-ferrous metal.

13. A storm drain filter system in accordance with claim 1 wherein the liquid capturing chamber is comprised of fiberglass.

14. A storm drain filter system in accordance with claim 1 wherein the perforated metal filtering plates are made of a non-ferrous material.

15. A storm drain filter system in accordance with claim 1 wherein the perforated metal filtering plates can be removed and replaced.

* * * * *